United States Patent [19]

Rauskolb

[11] 4,188,731

[45] Feb. 19, 1980

[54] METHOD AND APPARATUS FOR ELIMINATING WET STREAKS IN FIBROUS SHEETS OR WEBS BY INFRA-RED RADIATION

[76] Inventor: Fred W. Rauskolb, 86 Main St., Thomaston, Me. 04861

[21] Appl. No.: 925,051

[22] Filed: Jul. 17, 1978

Related U.S. Application Data

[63] Continuation of Ser. No. 717,498, Aug. 25, 1976, abandoned.

[51] Int. Cl.[2] ..... F26B 3/30

[52] U.S. Cl. ..... 34/41; 34/4; 34/68; 34/108

[58] Field of Search ..... 34/4, 41, 60, 68, 108, 34/110

[56] References Cited

U.S. PATENT DOCUMENTS

| | | | |
|---|---|---|---|
| 2,308,239 | 1/1943 | Bell | 34/4 |
| 2,309,993 | 2/1943 | Skagerberg | 34/41 |
| 3,040,807 | 6/1962 | Chope | 236/44 R |
| 3,293,770 | 12/1966 | Rauskolb | 432/146 |
| 3,864,842 | 2/1975 | Sawyer | 34/41 |
| 3,973,417 | 8/1976 | Greer | 34/4 |

OTHER PUBLICATIONS

Pages 40, 41, 42, and 43—Paper Trade Journal "New system for Moisture Control and Moisture Profile Correction" by F. W. Rauskold and F. C. Keeney.

*Primary Examiner*—John J. Camby

[57] ABSTRACT

Method and apparatus are disclosed for eliminating wet streaks in fibrous sheets or webs by infra-red radiation, the method providing means for determining where, lengthwise of the dryer section such radiation should be applied, and the apparatus providing one or more units to be there incorporated and capable of control in a manner such as to enable the radiation to be applied wherever widthwise of the web the moisture content of the web is excessive.

5 Claims, 5 Drawing Figures

METHOD AND APPARATUS FOR ELIMINATING WET STREAKS IN FIBROUS SHEETS OR WEBS BY INFRA-RED RADIATION

This is a continuation of application Ser. No. 717,498, filed Aug. 25, 1976, now abandoned.

BACKGROUND REFERENCES

U.S. Pat. Nos. 3,040,807 and 3,293,770.

BACKGROUND OF THE INVENTION

One of the most persistent problems in the operation of paper machines is the presence of wet streaks which interfere with the operation of the machine and the further processing and eventual use of the product. Wet streaks are caused by the malfunctioning of various parts of the paper machine. About half of these causes of wet streaks can be remedied by adjustments which can be made while the machine is running. The other half are not accessible while the paper machine is running: their correction must wait until the machine is shut down for a period of scheduled maintenance and parts replacement. The most important reason for such a shut-down is the replacement of the endless woven belt on which the paper is formed, called the Fourdrinier wire. In the days when these Fourdrinier wires were made of bronze they wore out rather quickly in five to eight days. These "wires" are now made of synthetic resin filaments, and now they last between twenty and thirty days. This makes it still more important to be able to eliminate the wet streaks, whatever their cause, quickly and surely, and to keep them from reaching the output end of the paper machine where the finished paper is wound into rolls.

A number of workers in this field have suggested that means for auxilliary drying be installed in various ways on the paper machine, using hot air or gas or electric infra-red radiation. (see Rauskolb U.S. Pat. Nos. 3,293,770 and Chope 3,040,807). It was also suggested that the auxiliary drying means be divided across the width of the paper machine into sections or zones since the wet streaks were never present over the whole width of the web, but were present at varying locations and in varying widths, and so needed to be treated or dried out in locations and in widths matching as nearly as possible the locations and widths of the wet streaks themselves. Then it followed that, since the water content of the wet streaks varied widely, the auxiliary drying means must also be variable over a considerable range of moisture contents. But given all or these specifications, one further problem existed which has hitherto not been practically and economically solved. When the wet streak is not as wide as the zone of the auxiliary drying means, the extra width of the zone acts to over-dry that part of the zone width of the sheet in excess of the width of the wet streaks, resulting in a narrow dry streak, which is almost as objectionable as the wet streak itself.

Another auxiliary drying means suggested was high-frequency electricity. This had the unusual possibility of drawing drying energy over only the varying width of the wet streak, and with an intensity proportional to the excess moisture content of the streak. While this method held promise of solving the wet streak problem the cost of the solution proved too great to be acceptable.

THE PRESENT INVENTION

It is the general objective of both the method and the apparatus to eliminate wet streaks where and as they occur by means of infra-red radiation, and while doing so to prevent the overdrying of areas bordering on the wet streak that are within specification for moisture content, utilizing the varying internal thermal resistances of the web, to eliminate the possibility of overdrying parts of the web while taking out excess moisture from other parts, and this while the occurrence of wet and dry streaks is completely random.

In terms of method the general objectives of the invention are attained by means of moisture content curves covering the full length of the dryer section, one based on the actual operation of the dryer while it operates on the basis of overdrying the web ahead of the size press, one a curve for the desired moisture content in the dried web, and another where, at the out-feed end of the dryer the moisture content would be the maximum to be expected in a wet streak with the dryer operating in accordance with the desired-moisture curve. Said one curve, hereinafter sometimes called the desired-moisture curve, is plotted using points on the actual drying curve multiplied by an extrapolation factor, the total effective length percentage of the dryer section divided by the percent of the total effective length percentage where the desired moisture content occurs on the curve representing the actual operation of the dryer.

Said other curve, hereinafter sometimes called the wet-streak curve, is plotted using points derived in the same manner but with the divisor of the extrapolation factor the percentage of the total effective length of the dryer section where the expected maximum moisture content of the wet streak is found on the actual drying curve.

The derived curves are then re-plotted in terms of the total effective length of the dryer section and the total volumes of water as percent of the volume of total voids in the web. A location lengthwise of the dryer section is then selected from a comparison of points for a given location of the dryer section where the re-plotted derived curves show a substantial difference in the volumes of water there represented.

In order to set up the dryer section for the operation of the streak dryer, it is necessary to reduce its drying effect to bring the moisture content in the dried web up to the desired moisture content specified in the aforementioned construction of the extrapolated drying curves. In this mode of operation wet streaks will occur, and the moisture content of the web will be indicated on the moisture profile gauge installed at the end of the dryer section.

Infra-red radiation is then applied in those zones in which wet steaks are occurring, and, where necessary, said radiation is adjusted to deal with those areas whose moisture content is intermediate between the maximum excessive moisture and the final moisture content specified in the desired-moisture curve.

Specific objectives are to render the drying step capable of meeting a wide range of drying requirements, and are attained by applying the radiation to either one or both surfaces of a web, varying the length of exposure of the web to the radiation.

In terms of apparatus, the general objective of substantially uniform moisture content in the web being produced is attained by adding to the conventional web dryer a high-intensity radiant drying means. To attain the objective such means must be more reliable, less subject to breakdowns, than the web-making machine itself, and it must be easy for the machine operator to use, and it must be an economically-feasible investment for the mill. The source of the radiant energy is the tubular quartz lamp known in the electric industry as type T-3, with an energy rating of 100 watts per linear inch of filament. Being small and compact, a number of these lamps can be assembled with conventional reflectors to produce flux densities up to 9 kilowatts per square foot of projected area. The radiation emitted is of a character which produces rates of drying which are satisfactory for the purpose but is of such a character that scorching of the fibrous web is prevented under leveling drying conditions.

Such lamps are used to attain the objectives of the invention by incorporating them in one or more panels for one or both surfaces of the web, each panel extending the full width of the web and including a large number of zones with each zone including a series of such lamps, the lamps closely spaced and so arranged that the energy may be applied to the web by zones or the energy in any zone reduced by varying the number of lamps energized.

These and other objectives such as ease of use and of maintenance are attained by the design of the required features. Dual purposes are served by ducts carrying cooling air to the radiant faces of streak dryer panels, since they also act as stiffening members of the panels.

BRIEF DESCRIPTION OF THE DRAWINGS

In the accompanying drawings preferred embodiments of the invention are shown, and.

Figure 1:
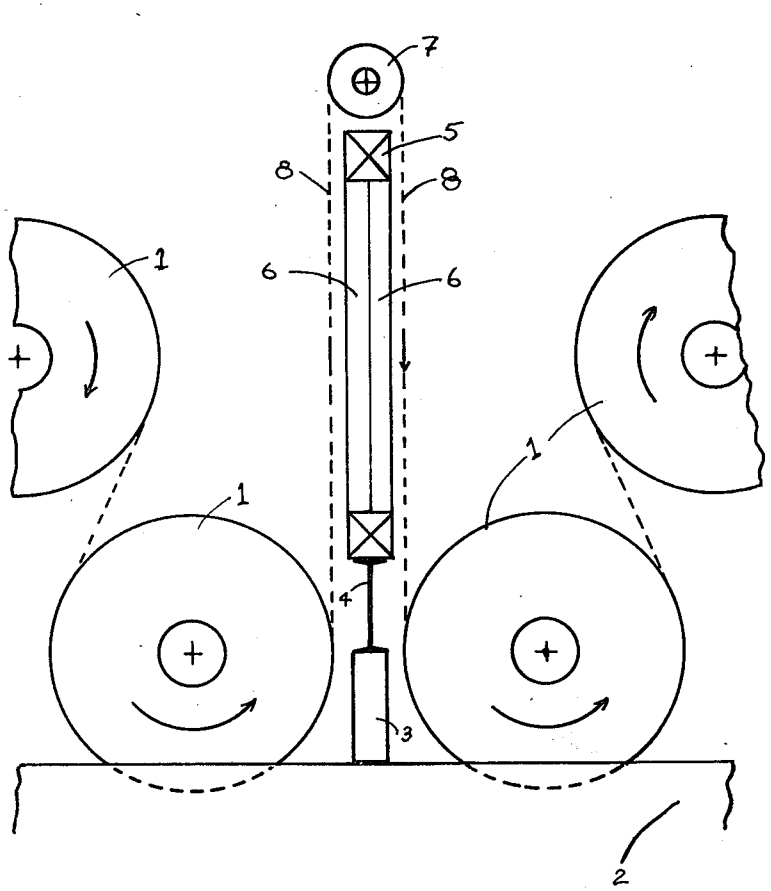
FIG. 1 is the end elevation of a streak dryer, installed in the location from which an upper drying drum was removed.

In the embodiment of the invention illustrated in FIG. 1 the apparatus is installed in a section of the web-producing machine occupying the space from which a top dryer drum was removed, similar drums are indicated at 1. The streak dryer is supported from machine floor 2 by support piers 3 and I-beam 4, which I-beam extends the full width of the web-producing machine, hereinafter called the machine, the streak dryer having two panels 6. Upper and lower hollow square structural members 5 support two oppositely facing streak dryer panels 6, the panels 6 detailed in connection with FIG. 5: the lower member is secured to the beam 4 and both members 5 serve to deliver the necessary cooling air from blowers, not shown, the members 5 having appropriately spaced and dimensioned ports. The web 8 is entrained on support roll 7 creating two substantially parallel courses exposing one face of web 8 to the radiating panels 6.

Figure 2:
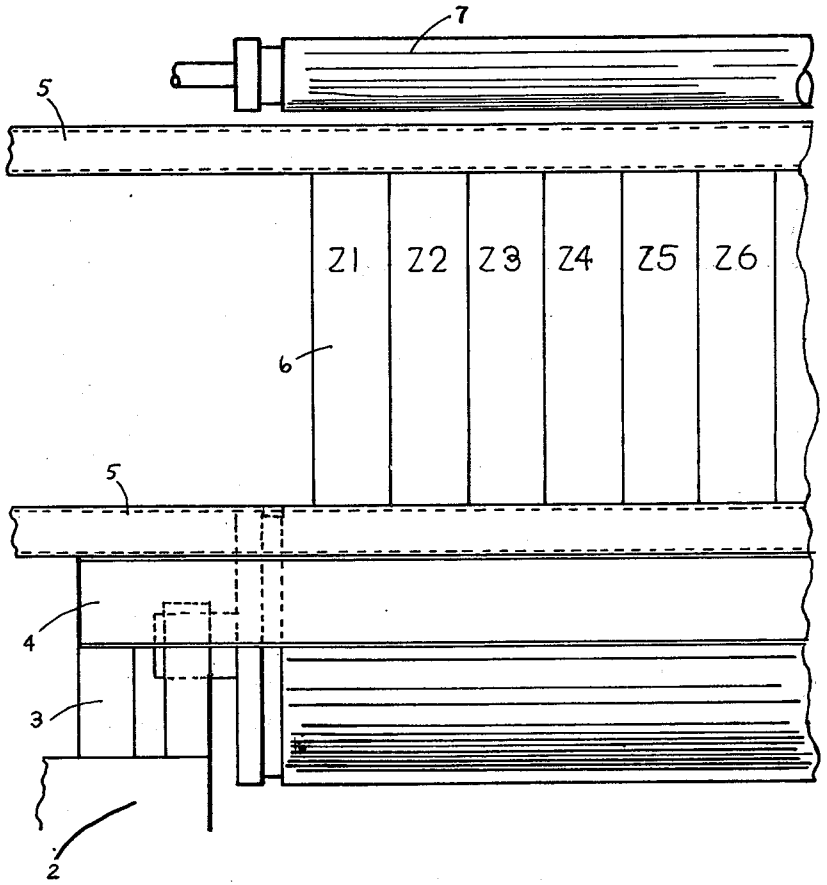
FIG. 2 is the partial elevation of a streak dryer, axis transverse of the web-producing machine, showing several transverse drying zones of the streak dryer.

FIG. 2 shows the streak dryer arrangement in FIG. 1 in a view of the transverse elevation of the streak dryer in FIG. 1. Only a part of the transverse length of the apparatus is shown. There may be an additional number of zones of any convenient dimension to accomodate the maximum width of web produced by the machine.

Figure 3:
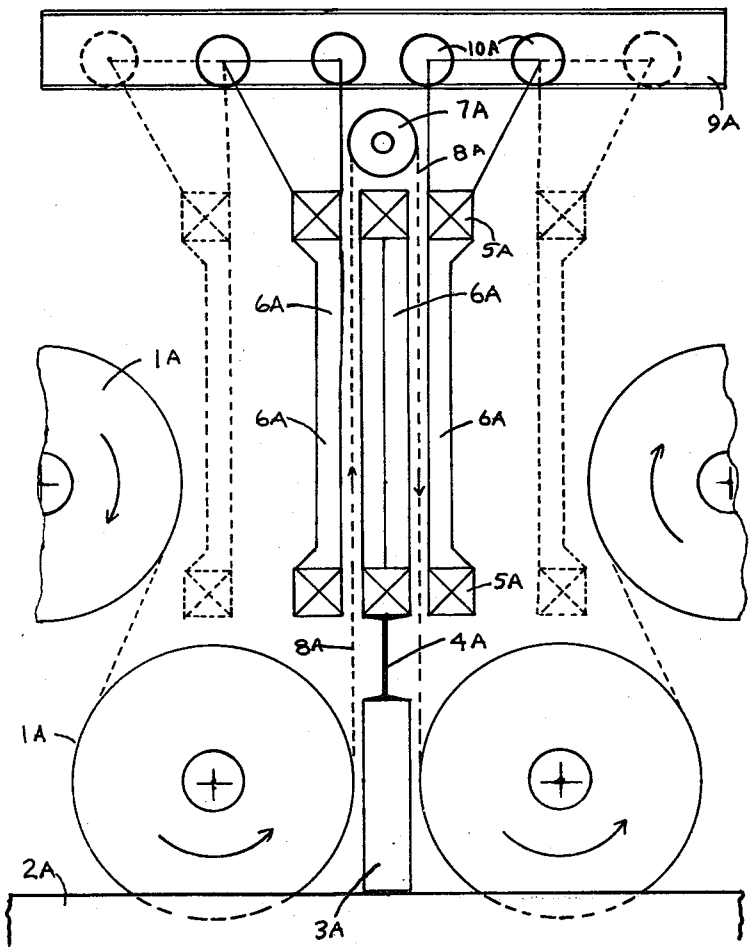
FIG. 3 is the end elevation of a streak dryer having four radiant panel faces so as to irradiate and have a leveling drying action on both faces of the web located in the space from which a top dryer drum was removed.

FIG. 3 shows the end elevation of a streak dryer having four radiant panel surfaces, the panels 6A being arranged as a central pair fastened together to form one double panel, and two simple panels 6A arranged so that the double unit irradiates one face of the web while the two separate single panels irradiate the opposite face of the web. The two dotted representations of single panels 6A show the positions of these panels for inspection and maintenance. This streak dryer is shown supported from beneath through the piers 3A and I-beam 4A. The two movable panels are supported from above by I-beams 9A and trolleys 10A, allowing the two movable panels to be separated from the central panel assembly 6A—6A as required. In this figure the streak dryer occupies space where a top dryer drum was previously situated.

Figure 4:
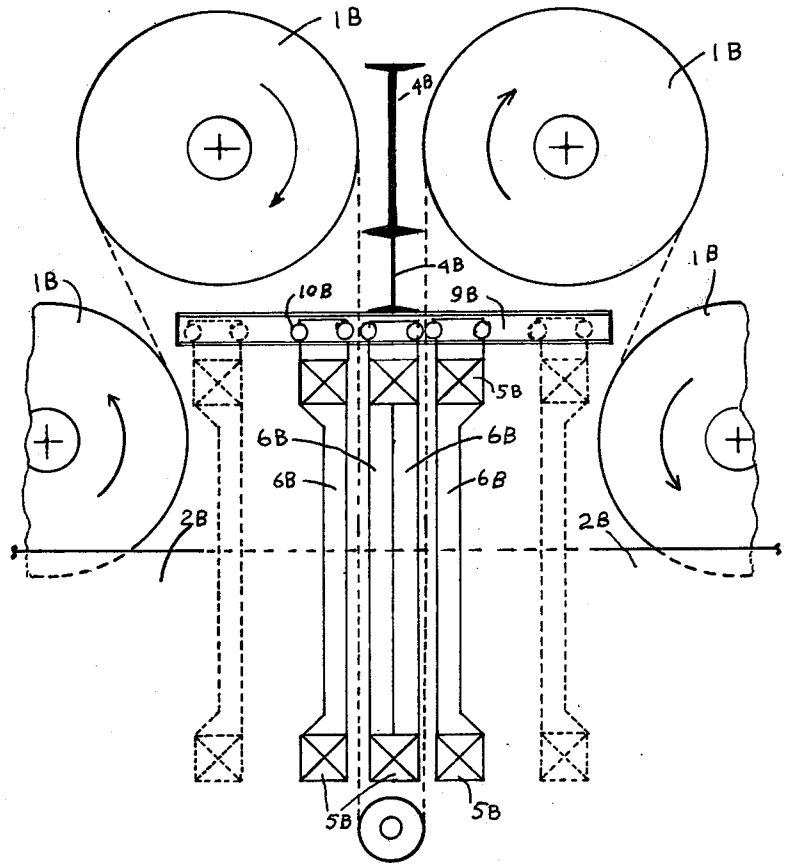
FIG. 4 is a similar end elevation of a four-panel streak dryer located in the space from which a bottom dryer drum was removed.

FIG. 4 shows the end elevation of a streak dryer also having four radiant panel surfaces, and a irradiates both faces of the web. The streak dryer here shown occupies the space from which a bottom dryer drum was removed, and is supported wholly from above through an I-beam assembly 4B. The two single-faced panels 6B are separately supported by I-beam 9B and end trolleys 10B.

Figure 5:
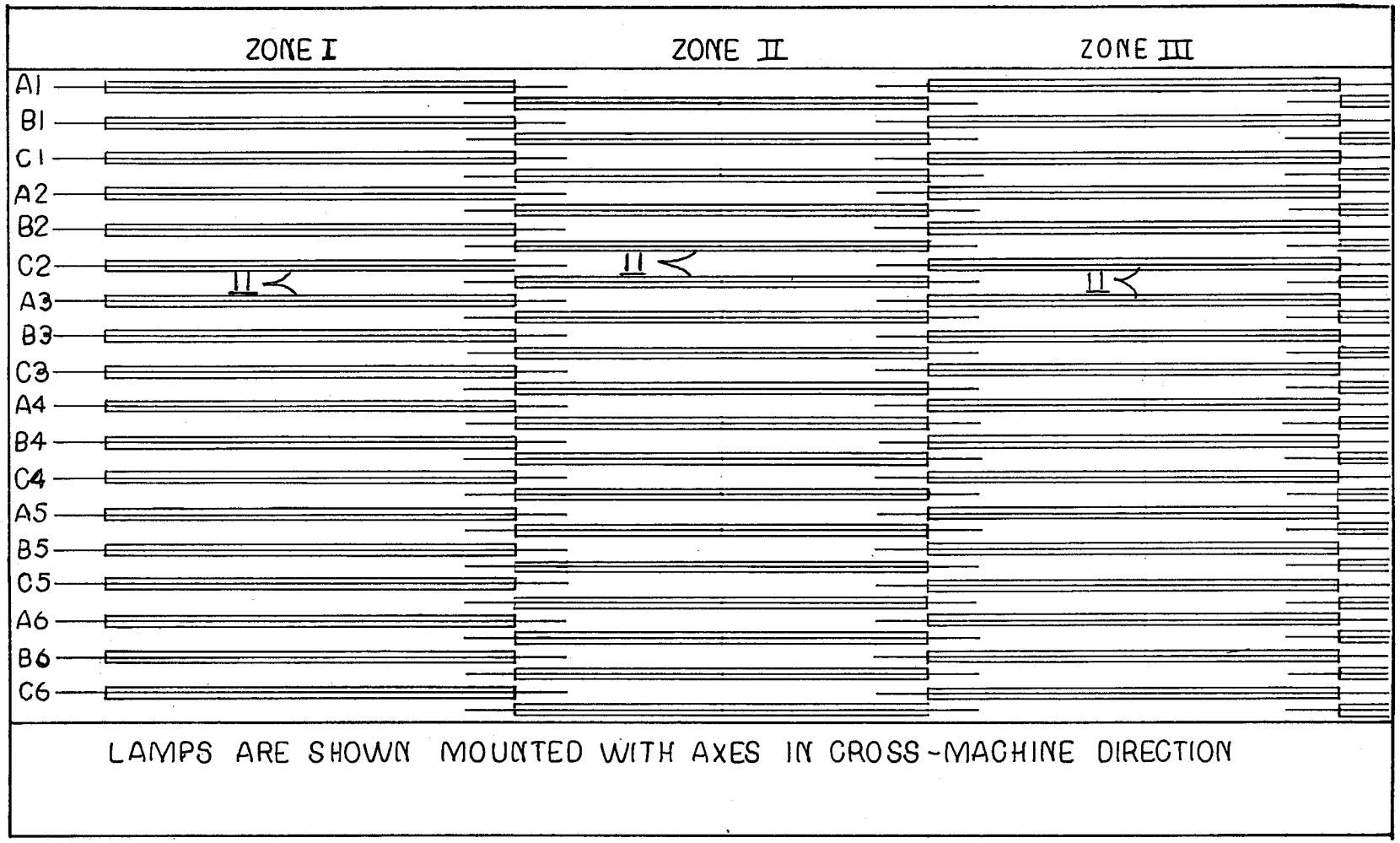
FIG. 5 is a partial view of the arrangement of T-3 quartz IR lamps shown as approximately 2-foot sections of three zones marked I, II, and III.

FIG. 5 shows a part of the radiant face of a radiant panel, and the preferred arrangement of the tubular quartz lamps type T-3 on the face of the panel section. These tubular lamps have a diameter of $\frac{3}{8}$ inches. The particular lamp represented here has a lighted length of 16 inches, and an overall length of approximately 20 inches. In FIG. 5 the lamps are shown by parallel lines for the lighted section of each lamp, and by a single line for the approximate 2 inches of unlighted section which includes a lamp seal incorporated in each unlighted end section. The lamps are staggered so that there may be no unlighted gap between two adjacent zones when both zones are on, and when a wet streak lies partly in each of the two adjacent active zones. The lamps are backed by reflectors of conventional design, and so are not detailed here. Because the temperature of the end seals on these lamps must be maintained below a temperature of 650 degrees Fahrenheit, they are cooled by air distributed by rectangular duct members 5 in FIGS. 1 and 2, members 5A and 5B in FIGS. 3 and 4 respectively. The designations in the left margin of FIG. 5 identify lamp positions for the purpose of indicating various ways of connecting the lamps so that the power loads on 3-phase power will always be balanced. It will be evident that lamps can be switched on or off in groups of lamps that number three or multiples of three. Since type T-3 lamps are most effective and have their longest service life if they are always energized at their manufacturer-rated voltage, it is not feasible to regulate and reduce voltage to reduce heat output. This is best done by switching off proportional groups of lamps, always in multiples of three so that loads are balanced at all times.

Before describing a wet streak dryer in accordance with my invention, additional background is discussed.

In terms of paper machine operation, wet streaks hurt both product quality and product cost. Present practice is to over-dry the web before it reaches the size press, bringing the average moisture content down to two percent or less. Doing this makes for better, more uniform sizing, which in turn helps to keep the printing properties, for example, more uniform overall. But over-drying to this extent robs the web fibers of an important part of their natural resiliency. This produces paper which is not as strong or as flexible as it would have been had its moisture content not been allowed to fall below 6% or 7% at any time during its manufacture. Paper which is dried to lower moisture content loses *permanently* the very moisture radicals (OH-groups) that give the fibers their resiliency and hence enhance the tear, bursting, tensile and folding strength of the paper. Elimination of wet streaks would produce a sheet with better strength characteristics at a lower fiber content, saving money for the mill by replacing fiber with water to the extent of 1% to 2%, and with the blessing of the printer or converter who would get a better sheet for his purposes.

A second consequence of eliminating wet streaks by over-drying is the loss of production. This is because over-drying involves slowing down the machine so that the dryer drums will take out more water from the sheet. Such a slow-down reduces production by several percentage points. By using a streak dryer it becomes possible to increase machine speed and output by these percentage points, or more. The resulting incremental tons of product make more profit per ton than does a ton of paper that was run more slowly to over-dry. This incremental profit will go a long way toward justifying the installation of a streak dryer.

GENERAL SPECIFICATIONS FOR STREAK DRYER COMPONENTS

Any equipment sold for use on a paper machine must be very carefully designed for that use. As far as breakdowns are concerned, a streak dryer must be more reliable than the paper machine itself. It must be easy to operate and the paper machine operator must be satisfied that its addition to his machine will make his job easier and his product more satisfactory. To be acceptable to the paper industry a streak dryer must be a very practical unit.

Leveling Action

The streak dryer must be able to reduce wet streaks to the specified average moisture content while not over-drying adjacent areas of the web which would be within moisture specifications.

Infra-Red Radiation Source

While the streak dryer can be designed to operate from electricity, gas or oil, the paper industry seems to prefer electricity. My preference is for electric tubular quartz lamps which are known as type T-3. These are made of quartz tubing approximately ⅜ inch diameter, sealed at both ends, evacuated or filled with an inert gas, enclosing a coiled metallic wire as a filament. The operating temperature of the filament is 3500 degrees Kelvin. This quartz infra-red lamp uses energy at the rate of 100 watts per linear inch of coiled filament and, properly baffled, lamps may be arranged parallel to each other at center distance of 1½ inches from each other. In such an arrangement the total power is 9 kilowatts per projected square foot. This produces the minimum flux density that is practical for streak dryers on paper machines. If the flux were significantly less, the streak dryer would require significantly longer runs of paper through the streak dryer, and this would not always be feasible. These quartz lamps have the property of drying well while not tending to scorch the exposed faces of paper or paperboard webs which some other infra-red sources have a tendency to do. These lamps can be turned on and off as often as required without damage to the lamps. Most of the other types of infra-red sources are damaged by fast changes in temperature, that is, by thermal shock. Some are also damaged by mechanical vibration or shock. I believe that the T-3 lamp is the most practical source of infra-red energy for streak dryers on paper machines.

Three-Phase Power

Power will generally be supplied by the mill as 440 or 460 volts, 3-phase, 60 cycles. The mills will insist that, regardless of switching arrangements, the power load be balanced at all times. Since good lamp life depends on the lamps being used at their rated voltage, some use of transformers on the main power supply may be necessary.

Modulation of Zone Heat Output

This will be accomplished by switching groups of lamps on and off as required, keeping in mind that this must be done in groups of multiples of three in order to maintain balanced three-phase power loads at all times. It is not practical to use variable voltage control since the T-3 lamps operate best and have their longest life (5000 hours) when operated at their rated voltage. Consequently switching controls are arranged to handle fractions of whole drying zones in order to regulate the total zone flux from zero to full power by sequential intermediate steps.

Streak Dryer Structure

The dryer panels and their supporting structure must be mechanically stable through the range of operating temperatures and must be very resistant to oxidation and warping. Heat-resistant alloys are used where needed. Panels are designed so that lamps can be changed easily during scheduled downtime for the paper machine.

Fire Protection

Adequate protection against fire started in torn paper as a result of a web break must be supplied with a streak dryer. A fixed installation is the most effective type. Automatic and manual controls are supplied. Water fog nozzles are used because water fog puts out paper fires quickly without flooding the area. Since this equipment is standarized and is available from a number of suppliers it is not described further here.

DRYING OF FIBROUS WEBS

At the first paper surface encountered by infra-red radiation three things happen:

1. Approximately 40% of the radiation is reflected
2. Approximately 60% of the radiation is absorbed
3. Most of the heat that is so absorbed is transmitted to the interior of the fibrous web by conduction by way of three paths:
   a. solid water in the interstices of the fibers
   b. water films on the surfaces of the fibers
   c. by conduction through the fibers themselves.

Path "a" has the highest rate of heat transfer
Path "b" has an intermediate rate
Path "c" has a low rate of heat transfer From this it will be seen that as water evaporates from a fibrous web such as paper, paperboard or textiles it becomes harder and harder to evaporate more water. It takes more heat stored in the web plus more time for equivalent masses of water to leave the web. If the time of exposure is held constant the water leaves the web on a declining-rate curve similar to the latter part of the drying curves of most paper machines. This non-linearity produces the leveling type of drying. It acts this way because infra-red radiation becomes heat in a body when it is absorbed by the surfaces of the body that it strikes directly. Because the heat conductivity of water is several times that of individual fibers the moisture present in the web conducts the greater part of the heat into the interior of the web. To repeat, drying of the leveling type is due to the declining rate of heat transfer in a web caused by the reduction in the moisture content of the web as it runs through a conventional dryer.

Think of a very wet web, and visualize the fibers completely immersed in liquid water. This is a fair picture of a wet web entering the dryer section of a paper machine. Now, as the water evaporates, the two faces of the web go from conditions of path "a" to conditions of path "b". For the sake of clarity, let us take one half of the cross-section of the web. Imagine it magnified a thousand times, and watch what goes on inside it. As radiation strikes the top surface of the web it is absorbed by the very top layer of fibers, and the radiant energy changes into sensible heat. The sensible heat then passed, by conduction, into a layer of path-type "a", then into path-type "b", then into path-type "c", as more and more water evaporates progressively. The solid water in condition "a" evaporates, steadily lowering the water level in the condition "a" stratum, gradually decreasing the liquid water until condition "b" is reached. Further drying takes out more water, and now near the surface of the sheet condition "c" prevails. This increases the thermal resistance of the total heat path, and decreases the amount of heat that can get down into the lower area where some condition "b" is still available. As the thickness of the upper layer in condition "c" increases, very little heat can get thru to evaporate any more water, although some water is still available for further evaporation. But now the path resistance from the center of the web to the top surface is so high that, despite the sizeable flux still impinging on the web, the web now, in this area has too little conductivity to evaporate any more water.

Taking two areas of differing moisture content, one of normal moisture and the other a wet streak, there is a point somewhere along the dryer section where the difference in water content, and the water "level" inside the web becomes importantly large, and then the heat flux which is large enough to remove a substantial amount of water from a wet streak area meets enough added heat transfer resistance in an area which will have inspecification moisture content when it reaches the end of the dryer section, to attenuate evaporation to the point where no significant amount of water will leave this part of the web, and therefore the area approaching normality will not lose enough water under this heat flux to over-dry it. The objective of the method claimed in this invention is to determine at what point along the conventional dryer section leveling will be optimum for most of the grades of web products run on a particular web-producing machine.

STREAK DRYER PLACEMENT CALCULATIONS

To add a leveling streak dryer to an existing paper machine dryer section it is necessary to place it in the declining-rate part of the dryer section, and in the part of it where the rate of change of drying is maximum. To do this it is necessary to plot and compare a family of drying curves, not less than three such curves for one determination. (A drying curve plots water in pounds per hour per foot of web width against percent of dryer section traversed.) The mill can supply the basic curves for the machine on which the streak dryer is to be installed. These curves must be derived from the production of several grades that are often made on this machine. Preferably the mill should make available several curves from a particular grade taken over a period of several months. These should all be plotted and compared with each other to weed out any data that is not typical and consistent. It is very important to get curves which show the usual over-drying up to the size press, where moisture is often taken down almost to bone dry, to $1\frac{1}{2}$% to $2\frac{1}{2}$%. The curves should be composed of as many data points as possible in the dryer section in the interest of accurracy in the curves which will be extrapolated from the basic curves the mill gives you.

1. From production data associated with the basic curve(s) there must be derived a constant that is also basic: that is pounds of bone-dry stock per hour per foot of web width. The accuracy of this figure is important. Data needed to calculate this value is:
   a. machine speed in feet per minute
   b. basis weight per ream
   c. square feet of web per ream
   d. the desired average moisture as % wet basis of % dry basis. figure consistently in either basis.
2. Also, from production personnel, get their best estimates of the following:
   a. future desirable average moisture, after elimination of wet streaks
   b. maximum moisture content of wet streaks when machine is run so as not to over-dry
   c. best estimate of caliper of unfinished, uncalendered, unsized in thousandths of an inch, of the grades for which they have furnished drying curve data. This information is important.
3. Carefully plot the basic drying curve(s) on semi-logarithmic graph paper, 3 cycles×10 divisions, $8\frac{1}{2}''\times 11''$ or larger. This type of plot will be more accurate toward the dry end of the drying curve(s), which is where accuracy is needed.

As above, values plotted will be pounds of water per hour per foot of web width on the logarithmic scales against percent of dryer section traversed, plotted on the linear scale.

4. Determine the extrapolation constants for at least two extrapolation curves per grade being checked:
   a. standard moisture content (future) at 100% of dryer, or take point entering the size press as being 100% of the effective dryer if stock is now being over-dried to get more even sizing.
   b. maximum moisture content of wet streaks (future) expected at end point of dryer used above in 4a.

Determine extrapolation constants by construction, as follows:
   i. on the basic drying curve mark the final desired moisture content (4a) on the ordinate at the point of 100% of dryer
   ii. project from this point back to intersect the basic curve at a point less than 100% on the abscissa
   iii. using this intersected value of percent of dryer, compute the improper fraction 100/X do this for both extrapolated curves per grade, i.e. for specified average moisture (future) (4a) and for maximum expected wet streak moisture (4b)

iv. values for points on the extrapolated curves are the products of the point values for percent of dryer traversed multiplied by the appropriate extrapolation constant. The pounds per hour per foot of web width for water for each point on the basic curve remain unchanged. Draw smooth curves through the calculated points for each extrapolated curve.

5a. Calculate the total volume of a standard area of web using the best caliper value available, that of uncalendered, unsized stock, if possible.

5b. In terms compatible with 5a, above, and using 1.55 or the pyknometer specific gravity for the fibers in the web being calculated, compute the volume of solid fiber for the standard area used in 5a, above.

5c. Subtract 5b, above from 5a, above, thus determining the volume of voids for the standard area of this web.

5d. Calculate the voids in 5c as percent of the total volume of the standard area of the web.

To find the best place in the dryer section for the streak dryer, the place where leveling will be optimum, we look for the percent of the dryer where the volume of water in the web, calculated as percent of voids, will have the greatest difference between the two extrapolated future drying curves, wet streak moisture vs. desired standard average moisture (future).

6a. Plot two graphs per grade being calculated, one for desired moisture content curve and the other for the maximum expected moisture:

x equals percent of dryer values y equals water as percent of voids

Start these plots at about 70% of dryer transversed.

6b. The optimum location(s) for the streak dryer for good leveling is where the difference between the two extrapolated curves is the greatest.

6c. In practice go through these calculations for a number of the grades most often run on this machine so that the range of products of this machine is taken into account and a good compromise is made between all of the possible locations for the streak dryer.

When a machine has a substantially constant tonnage output, the points in the dryer calculated for the various grades should not deviate greatly from one another.

From the foregoing it will be apparent that the invention is able to attain the desired reduction of excessive moisture contained in the web without significantly affecting parts of the web where the desired moisture content exists.

I claim:

1. The method of eliminating wet streaks in a fibrous web traveling through a dryer, said method including the steps of plotting a drying curve based on actual operation of the dryer with a moisture content in the web at the out-feed end of the dryer charactertistic of an over-dried product, plotting at least two derived curves with successively increased moisture contents at said out-feed end, the first a desired moisture content curve and the second moisture content curve characteristic of the maximum moisture content expected in wet streaks under future operation characteristic of the desired moisture content curve, each derived curve being multiplied by an extrapolation constant, said constant being the total effective length percentage of the dryer divided by the percentage of the total effective length of the dryer section at which the desired moisture content occurs on the actual drying curve, and for the curve of the expected maximum moisture content in wet streaks, the point at which the expected wet streak moisture content occurs on the actual drying curve, replotting said derived curves in terms of total effective length of the dryer section and the total volume of water as percent of the volume of total voids in the web, then selecting a location lengthwise of the dryer section where a comparison of points for a given location in the dryer section shows a substantial difference between the two replotted derived curves in the volume of water there represented as within the web with two moisture content levels representing internal thermal paths of different characteristics, adjusting the operation of the dryer to establish drying in accordance with the desired moisture content curve, and then applying to at least one surface of the web additional heat by means of high-intensity infra-red radiation transversely of the web where the moisture content of the web is excessive, the resistance of the thermal path at the lower moisture content level preventing any significant modification of that moisture content level, while the resistance of the thermal path at the upper moisture content level permits a significant reduction of the excess moisture content represented by such difference, thereby to so level the moisture profile of the web at the out-feed end of the dryer section that its moisture content is substantially uniform across the web.

2. The method of claim 1 and the additional step of also applying like radiation to the other surface of the web.

3. A dryer section for a web said dryer section including a series of heated drums and at least one intermediate high intensity infra-red heater, said drums arranged in such a manner that alternate drums of the entire series are engaged by opposite surfaces of the web and the web is supported and conveyed by the drums from one end of the dryer section to the other, means supporting the web to provide vertical courses where the moisture content of the web includes at least in part water films on the web fibers and in part web water more readily volatilized than said films, and thus representing non level drying, said one heater for one surface of the thus supported web, said heater including a series of transverse zones extending vertically in the machine direction to a predetermined extent, each heater zone including a series of closely spaced tubular, reflector-backed quartz lamps of substantial length and small cross sectional area, the lamps extending transversely of the path of the web and the series extending throughout the length of said zone, means to operate said heater in any transverse zone where said more readily volatilized water exists and to utilize such of the lamps in any operated zone throughout the extent thereof as are required to provide a high intensity, infra-red flux effective to remove the more readily volatilized web water in that zone without materially reducing the volume of said film water.

4. The dryer section of claim 3 in which the series of lamps in each zone are arranged as a series of groups, and the corresponding lamps of said groups are operable independently of the other lamps of the groups of that zone.

5. The dryer section of claim 3 in which there are four heaters, two arranged back to back between said vertical web courses, the other two spaced apart to receive said courses between them and disposed towards each other, and means supporting each of said other two heaters for movement towards and away from the proximate vertical courses.

* * * * *